United States Patent [19]

Lee

[11] 4,186,943

[45] Feb. 5, 1980

[54] SECURITY DEVICES

[75] Inventor: Peter D. Lee, Hertford, England

[73] Assignee: The Governor and Company of the Bank of England, London, England

[21] Appl. No.: 836,139

[22] Filed: Sep. 23, 1977

[30] Foreign Application Priority Data

Sep. 24, 1976 [GB] United Kingdom ..... 39820/76

[51] Int. Cl.[2] ..... B42D 15/00

[52] U.S. Cl. ..... 283/7; 283/9 R; 283/58

[58] Field of Search ..... 83/6, 7, 9 R, 57, 58

[56] References Cited

U.S. PATENT DOCUMENTS

| | | | |
|---|---|---|---|
| 3,245,697 | 4/1966 | Nugent | 283/7 |
| 3,414,998 | 12/1968 | Berger | 283/7 X |
| 3,919,447 | 11/1975 | Kilmer, Jr. et al. | 283/7 X |

FOREIGN PATENT DOCUMENTS 1394021 5/1975 Canada .

OTHER PUBLICATIONS

Optica Acta, 1973, vol. 20, No. 12, 925,937, "Optical Interference Coatings for Inhibiting Counterfeiting", by J. A. Dobrowolski et al-May 4, 1973.

*Primary Examiner*—Willie G. Abercrombie
*Attorney, Agent, or Firm*—Mawhinney & Mawhinney & Connors

[57] ABSTRACT

A sheet element, such as a banknote or other document of intrinsic value, incorporating an optical authenticating device comprising a thin film element, preferably in the form of a strip, or thread disposed within the thickness of the sheet element and having known characteristics of spectral reflectance and transmittance, and wherein in the region of a least part of the thin film element the sheet element is formed with a pair of superposed windows between which the thin film element extends so as to be visible through each window.

13 Claims, 7 Drawing Figures

FIG. 1.
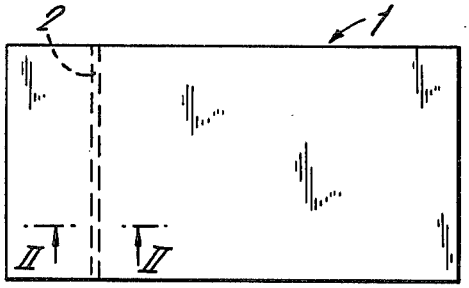
FIG. 2.
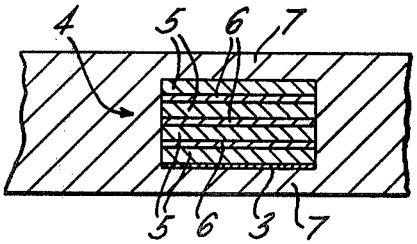
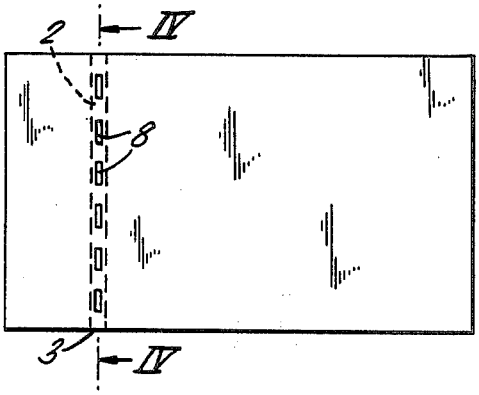
FIG. 3.
FIG. 4.
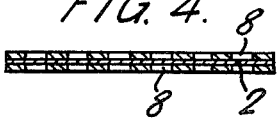
FIG. 6.
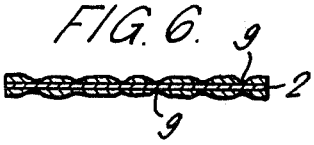
FIG. 5.
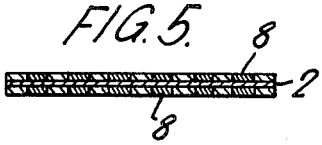
FIG. 7.
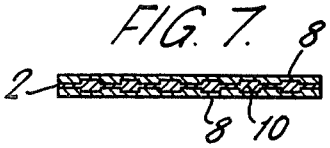

SECURITY DEVICES

FIELD OF THE INVENTION

This invention relates to security devices and more particularly to devices for authenticating various items of sheet materials, such as banknotes and other valuable documents, security personnel passes and the like.

BACKGROUND TO THE INVENTION

Present methods of preventing successful counterfeiting of, say, banknotes include the use of intricate designs, watermarks and inlaid metal strips, the intention being that the application of these devices to banknotes paper is sufficiently difficult to make it likely that forged notes will be readily recognizable by their poor quality. However, the effectiveness of such preventive measures is continuously being eroded as the techniques and apparatus available to the forger become more advanced and easier to operate, thus making it potentially easier to simulate the present form of banknotes.

The requirements therefore of any new authenticating security device are primarily twofold. Firstly the methods necessary for manufacturing the device or applying it to the sheet material employed should entail the use of resources which, by reason of their nature, complexity, cost or other factors, would not normally be available to a forger. Secondly, the authentic product should be readily recognizable to the eye without having to employ special apparatus.

Optical multilayer devices are presently commercially available, comprising a substrate bearing a number of stacked thin film layers of various materials. By careful selection of the thickness and composition of the layers the optical characteristics in particular of spectral reflectance and transmittance of the device can be controlled. For instance it is well known to produce accurate colour filters by depositing such thin film layers on glass substrates. Other devices can be specially made in which the substrate is a thin transparent sheet of plastics material, and which when illuminated by white light exhibit a strong reflection in a designated part of the spectrum, dependent upon the physical characteristics of the films deposited on the substrate to form the stack. Moreover the spectral reflectance of such a device can vary with the angle at which it is viewed, so that the part of the spectrum which is strongly reflected changes as the device is tilted in relation to the direction of the illuminating light. When such a device is viewed by transmitted light, a complementary colour to the main reflected colour is observed with a similar colour change on tilting. Such a device is difficult to manufacture and can be readily recognized under ordinary ambient viewing conditions. It is proposed to incorporate a device of this type for the purpose of authenticating an item of sheet material such as a banknote as mentioned earlier.

SUMMARY OF THE INVENTION

It is known to attach dichroic coatings to the surface of a banknote. The present invention constitutes an improvement to this in that it provides a sheet element incorporating an optical authenticating device comprising a thin film element disposed within the thickness of the sheet element and having known characteristics of spectral reflectance and transmittance, and wherein in the region of at least part of the thin film element the sheet element constitutes a pair of superposed windows between which the thin film element extends so as to be visible through each window.

The thin film element is preferably in the form of a narrow strip running through the material of the sheet, in a manner similar to that of the currently used security thread in a banknote. A number of pairs of windows may be formed by removing portions of the sheet material on each side of the thin film element at various points to form apertures through which the thin film element is exposed. Where the element is in the form of a strip, these window areas may be spaced regularly along its length or in a predetermined pattern. Alternatively the sheet material, which may be paper, may be made so thin at these points, for instance by applying to the sheet a watermark pattern causing variation in the material thickness, or a suitable substance may be applied to the material to make it locally transparent. A feature of this approach is that existing strip embedding technology can be used and that the preferred security device can remain. A further embodiment possessing this particularly advantageous feature is one in which the windows extend along the full length of such strip, and are constituted by relatively thin portions of the sheet element between which the strip extends.

By providing windows in the material on each side of the element, that is, by forming the sheet elements with portions through which the thin film element is visible, the optical effects of both reflection and transmission it produces when illuminated can readily be seen. It is additionally envisaged that the thin film stack may be varied in composition or interrupted at intervals throughout its length. It is further envisaged that the thread need not be linear, but can vary in surface shape in a predetermined pattern.

BRIEF DESCRIPTION OF THE DRAWINGS

Some embodiments of the invention will now be described by way of example, with reference to the accompanying drawings, in which:

FIG. 1 is a plan view of a banknote incorporating a security device according to the invention;

FIG. 2 is an enlarged section through a part of the banknote shown in FIG. 1 taken on the line II—II and illustrates the simplest manner of windowing and further illustrates the construction of a thin film thread;

FIG. 3 is a plan view of another banknote incorporating a security device according to the invention;

FIG. 4 is a section through the banknote shown in FIG. 3 taken on line IV—IV and illustrates another manner of windowing;

FIGS. 5 to 7 are sectional views, similar to FIG. 4 illustrating various alternative methods of windowing the material of the banknote.

DETAILED DESCRIPTION OF THE PREFERRED EMBODIMENTS

With reference first to FIGS. 1 and 2, a banknote 1 is formed with a narrow strip-like authenticating element 2 passing through the banknote paper and across the width of the note. The element 2 is formed by slitting into a continuous thread of required surface shape a pre-prepared length of material comprising a thin plastics substrate with a plurality of thin film layers vacuum deposited or otherwise applied thereon.

This strip is incorporated in the rectangular paper sheet on which the banknote is later printed. The preprepared material is constructed to exhibit predetermined characteristics of optical reflectance and transmittance, as discussed previously herein, which may vary with angle of incidence of illuminating light. A construction which has been found suitable, and which is illustrated in FIG. 2 consists of a transparent Melinex substrate 3 coated with a seven-layer stack 4 of alternate high and low refractive index materials, with layers having the high refractive index adjacent the substrate and at the top of the stack. The high refractive index layers 5 are three-quarters of a wavelength thick and have a refractive index of 2.30. The low refractive index layers 6 are one quarter of a wavelength thick and have a refractive index of 1.55. The reference wavelength is 540 nanometers. This combination gives reflection in the green part of the spectrum and transmission in the magenta when viewed normally.

Strip portions 7 of the banknote paper on opposite sides of the strip 2 each have a substantially uniform thickness of a magnitude, less than the thickness of the remainder of the banknote, such that the strip is visible therethrough, the portions 7 thereby constituting elongate windows through which these optical characteristics of reflection and transmission may be observed.

With reference not to FIGS. 3 and 4, in order that these optical characteristics of the strip 2 may be more clearly observed, the material of the note, which is commonly paper is formed at points 8, spaced along the length of the strip, with pairs of superposed windows between which the strip extends. This windowing is achieved in the embodiment of FIGS. 3 and 4 by removing or omitting small areas of the paper, at the points preferred 8, to form pairs of superposed apertures at these points.

In one method this may be achieved by using a laser to direct at the note surface a laser beam of precisely controlled power and direction so as to burn through the overlying paper at the predetermined points 8 while leaving the strip material unharmed. The laser may be arranged to follow the line of the strip 2 automatically. In another method the paper may be removed by mechanical cutting or abrasive means.

Since the banknotes of FIGS. 1 to 4 are windowed on both sides of the strip, the complementary colours produced by the multilayer material when viewed by reflected and transmitted light can be observed, and thus the note can readily be checked for authenticity. Various constructions of the strip can be used so that the main reflected colour, and its complementary transmitted colour can be made different for different denominations of banknotes, a feature which could be of use in vending, note dispensing and note accepting machines. Moreover, the composition of the stacked thin film layers may vary intermittently along the length of the strip to give alternate different reflected and complementary transmitted colours in alternate windows of the FIG. 3 embodiment, or the strip substrate may be alternately coated with the stacked thin film layers and uncoated along its length so that successive windows along the strip length expose the coated and clear uncoated portions alternately.

FIG. 5 illustrates an alternative method of windowing the banknote material overlying the strip 2. At the window points 8, the paper on both sides of the strip is impregnated with a suitable substance, for instance, paraffin wax, which renders it at least partly transparent.

FIG. 6 illustrates another alternative windowing method. Here a watermark pattern is applied to both sides of the banknote, so that the thickness of the paper on both sides of the strip varies along the strip, the pattern incorporating areas 9 where the paper is so thin as to be substantially transparent.

An alternative method of windowing by providing areas of reduced paper thickness is illustrated in FIG. 7. Here the thickness of the strip varies periodically along its length, both upper and lower surfaces being correspondingly contoured and when this strip is formed in a banknote of uniform overall thickness, the paper adjacent the thicker parts 10 of the strip is correspondingly thinner to form the windows 8.

When the thin film element is to be incorporated in a sheet element, such as a security card, which is relatively thick compared with the above described banknote, the sheet element may be assembled by inserting a thin film thread between two card portions which are subsequently fixed together and which are provided with preformed corresponding linear aperture arrays which in the finished card register with one another to expose the thread to each side of the card.

The above described devices exhibit considerable security value for a number of reasons. Firstly it would be obvious from the contrast of the appearance of the strip when viewed alternately through the paper and through the windows, either by transmitted or by reflected light, that it consists of a thread or other material inside the paper and cannot, therefore, be easily simulated by any print or ruling on the surface. Secondly, where viewed directly through the windows its appearance would be so characteristic both by reflected and transmitted light and with change of angle that it should not be possible to mistake it for any other commercially available material. Thirdly, this particular type of stacked thin film material in this form could only be produced with difficulty and with considerable skill by those having a great deal of specialized knowledge and access to expensive specialized equipment.

Fourthly, the making of windows, which could be of any appropriate chosen shape, would be an extremely difficult and tedious task to perform without the use of the special techniques and skills required to manufacture the genuine article.

Furthermore, the portions of the spectrum which are reflected and transmitted could be so specifically selected by appropriate selection of the material that the strip could be used, with the appropriate authenticating equipment, as an automatic verifying device in a note handling or vending machine.

I claim:

1. A sheet element incorporating an optical authenticating device comprising a thin film dichroic element disposed within the thickness of the sheet element, said thin film dichroic element comprising a stack of thin film layers and having known characteristics of spectral reflectance and transmittance, and wherein the transmissivity of the sheet element varies about the thin film element so that at at least one point where said transmissivity is relatively great said sheet element constitutes a pair of superposed windows between which the thin film element extends so as to be visible though each window, thereby to permit observance of said characteristics of spectral reflectance and transmittance.

2. A sheet element according to claim 1 wherein the thin film element is in the form of a strip extending through the material of the sheet.

3. A sheet element according to claim 1 including a plurality of said pairs of superposed windows formed in the material of the sheet element at points spaced about the thin film element.

4. A sheet element according to claim 3 wherein said windows comprise apertures in the material of said sheet element, through which apertures the thin film element is exposed.

5. A sheet element according to claim 2 including a plurality of said pairs of superposed windows formed in the material of the sheet element at points spaced about the thin film element.

6. A sheet element according to claim 5 wherein said windows comprise apertures in the material of said sheet element, through which apertures the thin film element is exposed.

7. A sheet element according to claim 6 wherein the pairs of superposed windows are spaced regularly along the length of the thin film strip element.

8. A sheet element according to claim 3 wherein the thickness of the material on opposite sides of the thin film element varies, the portions of said material at which said thickness is relatively small constituting said windows.

9. A sheet element according to claim 8 wherein said sheet element has applied to both sides thereof a watermark pattern which extends over the thin film element to produce the variation in material thickness.

10. A sheet element according to claim 8 wherein the thin film element is of non-uniform thickness, and the sheet element is of uniform overall thickness such that the windows are disposed adjacent the portions of the thin film element at which the thickness of the latter is relatively great.

11. A sheet element according to claim 3 wherein the windows comprise portions of the sheet element material which are impregnated with a substance to increase the transmissivity of said material.

12. A sheet element according to claim 11 wherein the sheet element material is paper, and wherein said substance is paraffin wax.

13. A banknote consisting of a rectangular sheet element incorporating an optical authenticating device comprising a thin film element in the form of a strip disposed within the thickness of, and extending across the sheet element, said thin film element comprising a stack of thin film layers and having known characteristics of spectral reflectance and transmittance, and wherein the transmissivity of the sheet element varies along the said strip so that at at least one point where said transmissivity is relatively great the sheet element constitutes a pair of superposed windows between which the thin film element extends so as to be visible through each window, thereby to permit observance of said characteristics of spectral reflectance and transmittance.

* * * * *